US010309700B2

(12) United States Patent
Lee et al.

(10) Patent No.: US 10,309,700 B2
(45) Date of Patent: Jun. 4, 2019

(54) HIGH PRESSURE COMPRESSOR AND REFRIGERATING MACHINE HAVING A HIGH PRESSURE COMPRESSOR

(71) Applicant: LG ELECTRONICS INC., Seoul (KR)

(72) Inventors: Jingyu Lee, Seoul (KR); Jeonghyeon Park, Seoul (KR); Yeongcheol Ko, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 74 days.

(21) Appl. No.: 15/212,416

(22) Filed: Jul. 18, 2016

(65) Prior Publication Data

US 2017/0248353 A1 Aug. 31, 2017

(30) Foreign Application Priority Data

Feb. 26, 2016 (KR) ..... 10-2016-0023483

(51) Int. Cl.
*F25B 49/02* (2006.01)
*F25B 31/02* (2006.01)
(Continued)

(52) U.S. Cl.
CPC ..... *F25B 31/026* (2013.01); *F04C 18/356* (2013.01); *F04C 23/008* (2013.01);
(Continued)

(58) Field of Classification Search
CPC ..... F25B 13/00; F25B 49/02; F25B 49/022
See application file for complete search history.

(56) References Cited

U.S. PATENT DOCUMENTS 4,135,860 A 1/1979 Van Nederkassel
5,674,058 A 10/1997 Matsuda
(Continued)

FOREIGN PATENT DOCUMENTS

CN 1266947 9/2000
CN 1690417 11/2005
(Continued)

OTHER PUBLICATIONS

Korean Office Action dated Nov. 9, 2016 issued in Application No. 10-2016-0023483.
(Continued)

*Primary Examiner* — Ljiljana V. Ciric
*Assistant Examiner* — Alexis K Cox
(74) *Attorney, Agent, or Firm* — Ked & Associates LLP

(57) ABSTRACT

A high pressure compressor may include a casing in which a refrigerant discharged from a compression device is filled into an inner space provided with a drive motor, a suction pipe directly connected to a suction port of the compression device, a discharge pipe in communication with the inner space of the casing, a first valve provided at the discharge pipe or the suction pipe to control a flow of the discharged refrigerant from a high pressure side to a low pressure side when the drive motor is stopped, a bypass pipe connected between a discharge side and a suction side based on the compression device, and a second valve provided at the bypass pipe to move the refrigerant at the high pressure side to the low pressure side through the bypass pipe, thereby allowing a differential pressure operation to continue when the compressor is stopped.

19 Claims, 10 Drawing Sheets

(51) Int. Cl.

| | |
|---|---|
| ***F04C 18/356*** | (2006.01) |
| ***F04C 28/26*** | (2006.01) |
| ***F04C 29/00*** | (2006.01) |
| ***F25B 13/00*** | (2006.01) |
| ***F25B 41/04*** | (2006.01) |
| ***F04C 23/00*** | (2006.01) |

(52) U.S. Cl.

CPC ..... *F04C 28/26* (2013.01); *F04C 29/0085* (2013.01); *F25B 13/00* (2013.01); *F25B 41/04* (2013.01); *F25B 49/022* (2013.01); *F04C 2210/26* (2013.01); *F04C 2240/40* (2013.01); *F04C 2240/806* (2013.01); *F04C 2270/58* (2013.01); *F25B 2600/2501* (2013.01)

(56) References Cited

U.S. PATENT DOCUMENTS

| | | | | |
|---|---|---|---|---|
| 6,085,533 | A | 7/2000 | Kaido et al. | |
| 7,721,757 | B2 | 5/2010 | Ginies et al. | |
| 2001/0014289 | A1* | 8/2001 | Murakami | F04B 27/0895 417/269 |
| 2002/0020183 | A1* | 2/2002 | Hayashi | B60H 1/3229 62/298 |
| 2002/0036438 | A1* | 3/2002 | Nishiyama | H02K 1/148 310/168 |
| 2002/0078697 | A1* | 6/2002 | Lifson | F25B 31/004 62/84 |
| 2009/0217679 | A1* | 9/2009 | Raghavachari | F25B 1/10 62/77 |
| 2014/0020411 | A1* | 1/2014 | Li | F25B 49/025 62/56 |
| 2014/0099218 | A1 | 4/2014 | Hiwata et al. | |
| 2014/0182312 | A1 | 7/2014 | Lundberg et al. | |

FOREIGN PATENT DOCUMENTS

| | | |
|---|---|---|
| CN | 1699755 | 11/2005 |
| CN | 103511261 | 1/2014 |
| CN | 203785237 | 8/2014 |
| CN | 203962412 | 11/2014 |
| DE | 1163863 | 2/1964 |
| EP | 1589302 | 10/2005 |
| EP | 1 598 616 | 11/2005 |
| EP | 1 738 119 | 1/2007 |
| JP | 1983-079586 | 5/1983 |
| JP | 1984-184064 | 12/1984 |
| JP | 1988-140885 | 6/1988 |
| JP | 1995-247981 | 9/1995 |
| JP | 2000-205137 | 7/2000 |
| JP | 2002-250292 | 9/2002 |
| JP | 2003-314911 | 11/2003 |
| JP | 2003-314912 | 11/2003 |
| JP | 2004-218455 | 8/2004 |
| JP | 2008-509325 | 3/2008 |
| JP | 2014-185565 | 10/2014 |
| JP | 2016-020657 | 2/2016 |
| KR | 20-1995-0033637 | 12/1995 |
| KR | 10-2005-0102528 | 10/2005 |
| KR | 10-2006-0026812 | 3/2006 |
| WO | WO 2005/088212 | 9/2005 |

OTHER PUBLICATIONS

European Search Report dated Mar. 31, 2017 issued in Application No. 16 189 734.3.

Japanese Office Action dated May 30, 2017 issued in Application No. 2016-141960.

Taiwanese Office Action dated Sep. 13, 2017. (English Translation).

Chinese Office Action dated Jun. 5, 2018 (English Translation).

European Office Action dated Jan. 24, 2018.

Japanese Office Action dated Jan. 30, 2018.

U.S. Appl. No. 15/345,561, filed Nov. 8, 2016, Devon C. Kramer.

U.S. Office Action issued in U.S. Appl. No. 15/345,561 dated Apr. 5, 2019.

* cited by examiner

HIGH PRESSURE COMPRESSOR AND REFRIGERATING MACHINE HAVING A HIGH PRESSURE COMPRESSOR

CROSS-REFERENCE TO RELATED APPLICATION(S)

The present application claims priority to Korean Application No. 10-2016-0023483, filed in Korea on Feb. 26, 2016, which is herein expressly incorporated by reference in its entirety.

BACKGROUND

1. Field

A compressor, and more particularly, a high pressure compressor in which an inner space of a casing forms a high pressure portion, and a refrigerating cycle device having a high pressure compressor are disclosed herein.

2. Background

In general, a compressor is applicable to a vapor compression type refrigerating cycle (hereinafter, abbreviated as a "refrigerating cycle"), such as a refrigerator, or air conditioner, for example. Compressors may be divided into an indirect suction method and a direct suction method according to a method of sucking refrigerant into a compression chamber.

The indirect suction method is a method in which refrigerant circulating in a refrigerating cycle is introduced into an inner space of the compressor casing and then sucked into a compression chamber. The direct suction method is a method in which refrigerant is directly sucked into the compression chamber, in contrast to the direct suction method.

The indirect suction method and the direct suction method may also be classified as a low pressure compressor and a high pressure compressor, respectively. For the low pressure compressor, refrigerant is first introduced into a compressor casing and liquid refrigerant or oil is filtered out of the compressor casing, and accordingly, an additional accumulator is not provided therein, whereas for the high pressure compressor, an accumulator is typically provided at a side of suction to prevent the liquid refrigerant or oil from introduced into the compression chamber.

The high pressure compressor forms a high pressure portion in which an inner space of the casing is a discharge space, and an inner space of the accumulator forms a low pressure portion. As a result, when power of a refrigerating cycle is off during an operation, instant restart is disabled or not possible due to a large difference between a suction side pressure and a discharge side pressure. Accordingly, most air conditioners using a high pressure compressor implement an additional operation, a so-called "3-minute restart", for allowing an operation stop to continue for a predetermined period of time to secure an equilibrium pressure time.

In particular, in the unitary air conditioner field in the North America region, a fan in the refrigerating cycle is operated while implementing an additional operation, such as the 3-minute restart, when the compressor stops to use latent heat until a differential pressure generated during the operation of the refrigerating cycle device reaches an equilibrium pressure, thereby maximizing efficiency of the refrigerating cycle device. However, if a period of time for allowing a differential pressure of the refrigerating cycle device to reach an equilibrium pressure (hereinafter, a "differential pressure section" or "time required for equilibrium pressure") is long, an oil level within the compressor is reduced as well as the compressor is not restarted, thereby causing difficulties in applying the high pressure compressor to a refrigerating device, such as an air conditioner. In other words, oil within the compressor is leaked into an accumulator with a lower pressure through a gap between members due to a pressure difference to reduce the level of the oil, and a rotary compressor is not restarted even when a differential pressure between a suction pressure and a discharge pressure is small, such as 1 kgf/cm$^2$, due to characteristics thereof.

Consequently, when the compressor is stopped once, it is not easily restarted, and when input power is continuously fed during the process, an overload is generated on the motor, and as a result, a stop state of the compressor may be prolonged while operating an overload prevention device (OLP). Due to this, a period of time for allowing the compressor to reach an equilibrium pressure should not be long, thereby causing difficulties in applying a method of using latent heat during the time required for equilibrium pressure to the high pressure compressor field, such as a rotary compressor. Accordingly, in a region in which an efficiency of the refrigerating cycle device is emphasized, there is a problem of causing difficulties in applying the high pressure compressor to an air conditioner, for example.

Instead, in a unitary air conditioner to which the high pressure compressor is applied, a method of providing an orifice between the condenser and the evaporator to rapidly reach an equilibrium pressure may be applicable thereto. However, when a time required for equilibrium pressure is reduced using the orifice, the use of latent heat during the differential pressure section is also disabled, and thus, it is also disadvantageous in the aspect of efficiency, thereby causing difficulties in applying the high pressure compressor to a refrigerating device, such as an air conditioner.

BRIEF DESCRIPTION OF THE DRAWINGS

Embodiments will be described in detail with reference to the following drawings in which like reference numerals refer to like elements, and wherein.

DETAILED DESCRIPTION

Figure 1:
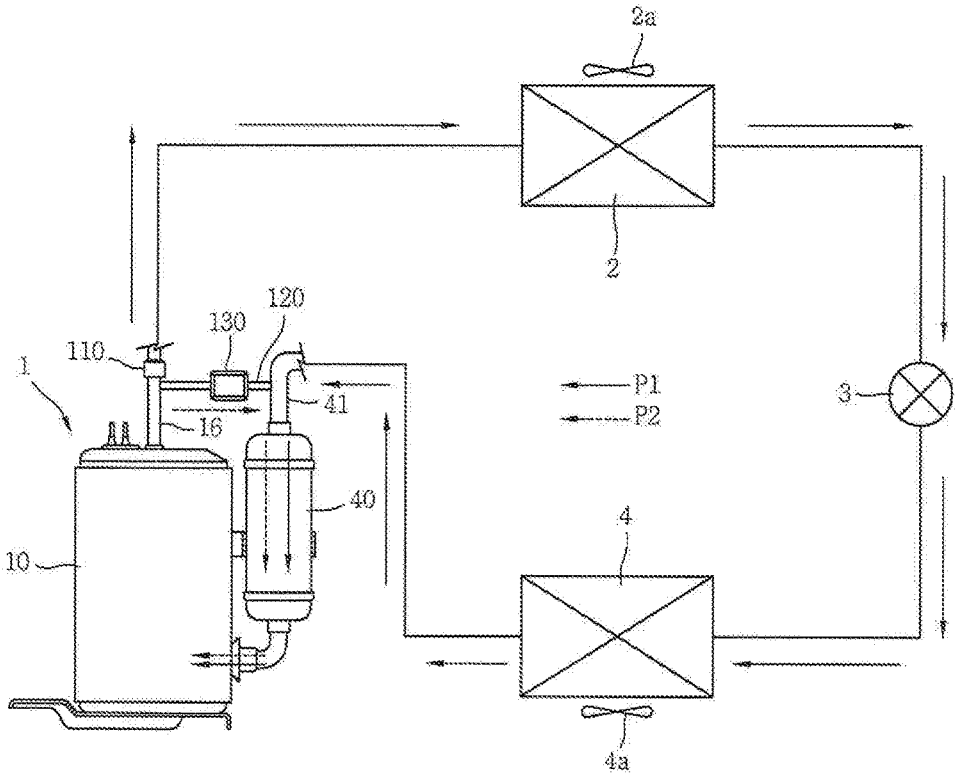
FIG. 1 is a schematic diagram illustrating a refrigerating cycle device according to an embodiment.

Hereinafter, a compressor, a refrigerating cycle device to which the compressor is applied, and an operation method of the refrigerating cycle device according to embodiments will be described in detail based on embodiments illustrated in the accompanying drawings. Where possible, like reference numerals have been used to indicate like elements, and repetitive disclosure has been omitted.

Figure 2:
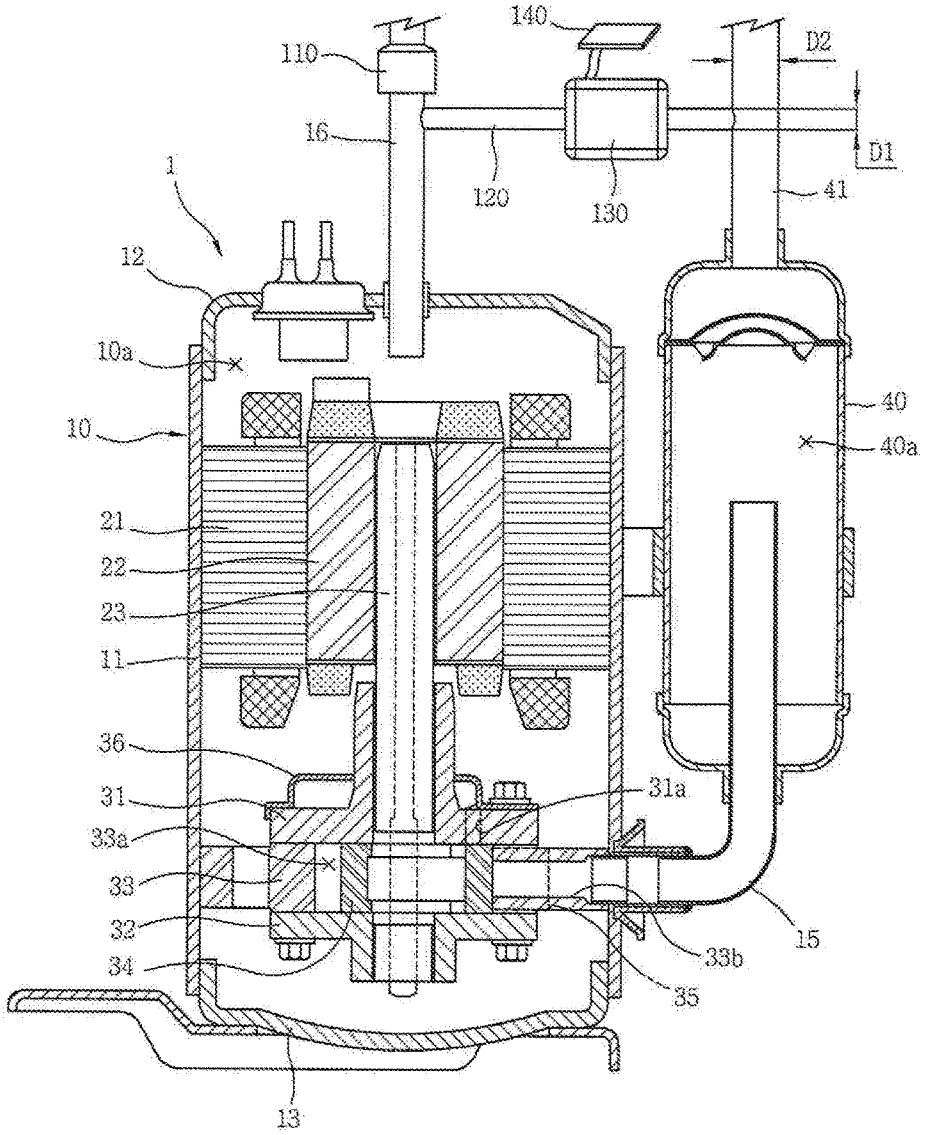
FIG. 2 is a longitudinal cross-sectional view illustrating a rotary compressor having an accumulator in the refrigerating cycle device according to FIG. 1.

FIG. 1 is a schematic diagram illustrating a refrigerating cycle device according to an embodiment. FIG. 2 is a longitudinal cross-sectional view illustrating a rotary compressor having an accumulator in the refrigerating cycle device according to FIG. 1.

Referring to FIG. 1, a refrigerating cycle device according to an embodiment may include a compressor 1, a condenser 2, an expansion valve 3, and an evaporator 4. In a case in which the refrigerating cycle device is applied to a unitary air conditioner, a compressor, an outdoor heat exchanger (condenser or evaporator), and an expansion valve may be provided at an outdoor unit or device, and an indoor heat exchanger (evaporator or condenser) may be provided at an indoor unit or device.

Referring to FIG. 2, in the compressor 1, which may be a rotary compressor, according to an embodiment, a motor drive may be provided in an inner space of a compressor casing 10, and a compression unit or device may be provided at a lower side of the motor drive. The motor drive and compression unit may be mechanically connected by a rotating shaft.

For the motor drive, a stator 21 may be pressed and fixed to an inside of the compressor casing 10, and a rotor 22 may be rotatably inserted into an inside of the stator 21. A rotating shaft 23 may be pressed and coupled to a center of the rotor 22.

For the compression unit, a main bearing 31 that supports the rotating shaft 23 may be fixed and coupled to an inner circumferential surface of the compressor casing 10, and a sub-bearing 32 that supports the rotating shaft 23 along with the main bearing 31 may be coupled to the main bearing 31 at a predetermined distance at a lower side of the main bearing 31, and a cylinder 33 that forms a compression space 33*a* may be provided between the main bearing 31 and the sub-bearing 32. A rolling piston 34 that compresses refrigerant while performing an orbiting movement along with the rotating shaft 23 in the compression space 33*a* may be provided in the compression space 33*a* of the cylinder 33, and a vane 35 that partitions the compression space 33*a* into a suction chamber and a compression chamber along with the rolling piston 34 may be slidably inserted into an inner wall of the cylinder 33.

The compressor casing 10 may include a circular cylinder body 11, both top and bottom ends of which may be open, and an upper cap 12 and a lower cap 13 that cover both the top and bottom ends of the circular cylinder body 11 to seal inner space 10*a*. A suction pipe 15 connected to an outlet side of an accumulator 40, which will be described hereinafter, may be coupled to a lower half portion of the circular cylinder body 11, and a discharge pipe 16 connected to an inlet side of the condenser 2, which will be described hereinafter, may be coupled to the upper cap 12. The suction pipe 15 may be directly connected to a suction port 33*b* of the cylinder 33 through the circular cylinder body 11, and the discharge pipe 16 may communicate with the inner space 10*a* of the compressor casing 10 through the upper cap 12.

The accumulator 40 may be disposed or provided at one side of the compressor casing 10, and an inner space 40*a* separated from the inner space 10*a* of the compressor casing 10 may be formed to have a predetermined volume within the accumulator 40. A refrigerant pipe 41 connected to the evaporator 4 may be connected to an upper portion of the accumulator 40, and the suction pipe 15 connected to the cylinder 33 of the compressor casing 10 may be connected to a lower portion of the accumulator 40.

The refrigerant pipe 41 may be connected to an upper surface of the accumulator 40, and the suction pipe 15 may be formed in an L-shape and deeply inserted and connected to an inside of the inner space 40*a* of the accumulator 40 by a predetermined height through a lower surface of the accumulator 40. As a result, a refrigerant passage may include a first refrigerant passage (P1) connected between a suction side and a discharge side based on the compression unit, and a second refrigerant passage (P2) branched from the first refrigerant passage (P1) to reduce a distance between an inlet of the first refrigerant passage connected to the suction side of the compression unit and an outlet of the first refrigerant passage connected to the discharge side of the compression unit based on the compression unit. A check valve 110, which will be described hereinafter, may be provided at the first refrigerant passage (P1), and a solenoid valve 130, which will be described hereinafter, may be provided at the second refrigerant passage (P2).

In the drawings, reference numerals 31*a* and 36 are a discharge port and a discharge muffler, respectively.

In a rotary compressor according to an embodiment, when power is applied to the stator 21, the rolling piston 34 performs an orbiting movement while the rotor 22 and the rotating shaft 23 rotate within the stator 21, a volume of the suction chamber varies according to the orbiting movement of the rolling piston 34 to suck refrigerant into the cylinder 33. The refrigerant may be discharged to the inner space 10*a* of the casing 10 through the discharge port 31*a* provided in the main bearing 31 while being compressed by the rolling piston 34 and the vane 35, and refrigerant discharged to the inner space 10*a* of the casing 10 may be exhausted to the refrigerating cycle device through the discharge pipe 16. Refrigerant exhausted to the refrigerating cycle device may be introduced into the accumulator 40 through the condenser 2, expansion valve 3, and evaporator 4, and liquid refrigerant and oil may be separated from gas refrigerant while the refrigerant passes through the accumulator 40 prior to being sucked into the cylinder 33, and a series of processes of sucking gas refrigerant into the cylinder 33 while evaporating liquid refrigerant from the accumulator 40 and then sucking it into the cylinder 33 may be repeated.

At this time, even when the compressor 1 is temporarily off, refrigerant which has been exhausted from the compressor 1 to the refrigerating cycle may move in a direction from the condenser 2 forming a relatively high pressure to the evaporator 4 forming a relatively low pressure by a pressure difference. Accordingly, when a fan of the refrigerating cycle device is operated in a state in which the compressor 1 is stopped, refrigerant may continue to exchange heat using latent heat while moving according to a pressure difference, thereby enhancing the efficiency of the refrigerating cycle device.

However, the foregoing rotary compressor is unable to restart even when a pressure difference between a suction pressure and a discharge pressure is small, such as 1 kgf/$cm^2$, due to characteristics thereof, and thus, it is unable to maintain a time required for equilibrium pressure for a long period of time. When the time required for equilibrium pressure is set to be relatively long, the compressor is unable to restart as the compressor does not reach an equilibrium pressure required for restart even though the user tries to operate the refrigerating cycle device again. When the time required for equilibrium pressure is set to be relatively short, latent heat may not be used during a differential pressure section or time period, thereby reducing energy efficiency in that amount or by a certain amount.

In consideration of this, according to embodiments disclosed herein, a check valve (hereinafter, "first valve") may be provided in or at a middle or middle portion of the discharge pipe at an outside of the compressor casing to prevent the discharged refrigerant from flowing back from the outside to the inside so as to allow a differential pressure operation to be long during a differential pressure section or time period corresponding to the time required for equilibrium pressure as well as a bypass pipe, and a solenoid valve (hereinafter, "second valve") to selectively open and close the bypass pipe may be provided between the middle of the discharge pipe and a suction side of the accumulator to allow a restart operation that rapidly reaches an equilibrium pressure during the restart, thereby efficiently implementing restart in a high pressure compressor, such as a rotary compressor.

Figure 3A:
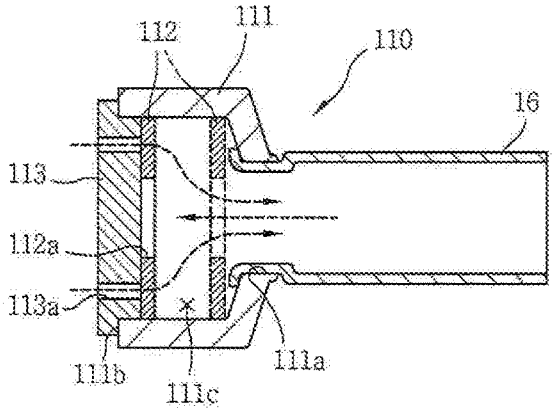
FIGS. 3A and 3B are longitudinal cross-sectional views illustrating a first valve and a second valve, respectively, in a compressor according to FIG. 2.
Figure 3B:
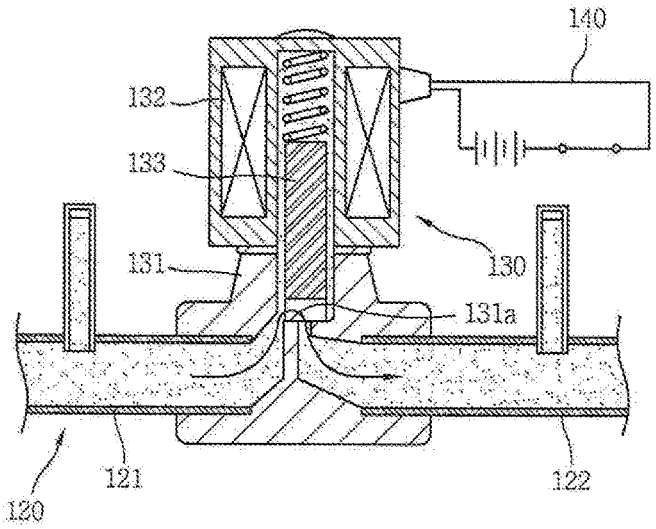
Figure 4A:
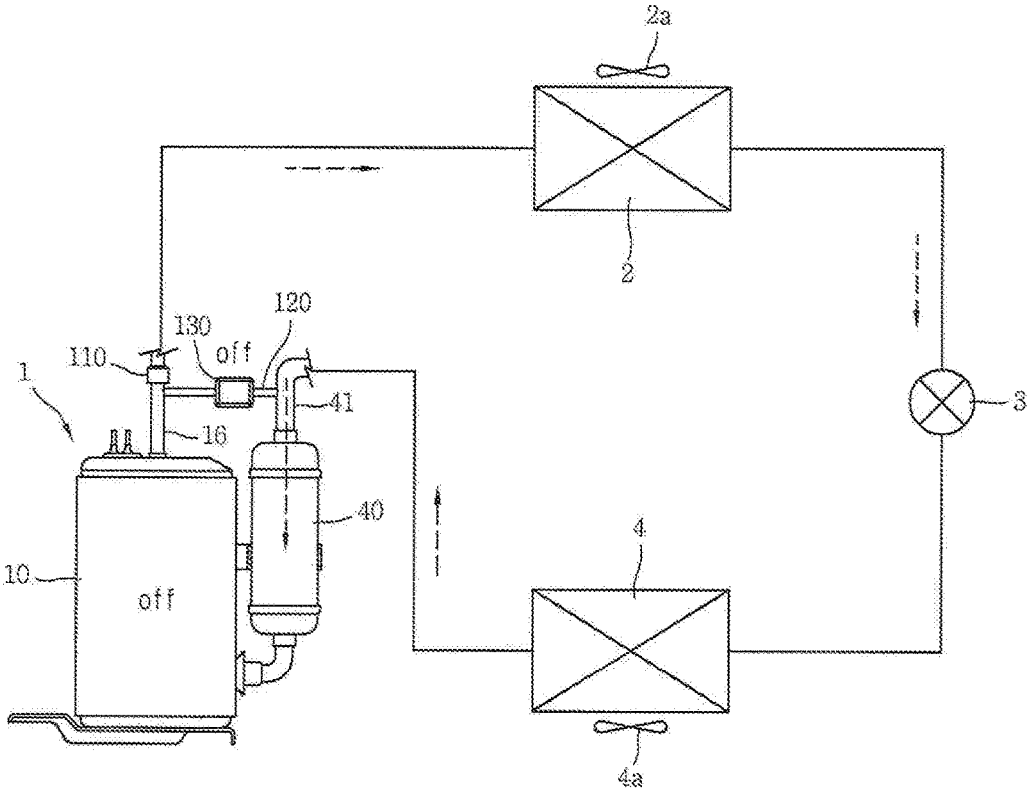
FIGS. 4A and 4B are schematic views for explaining a differential pressure operation and a restart operation in the refrigerating cycle device according to FIG. 1.
Figure 4B:
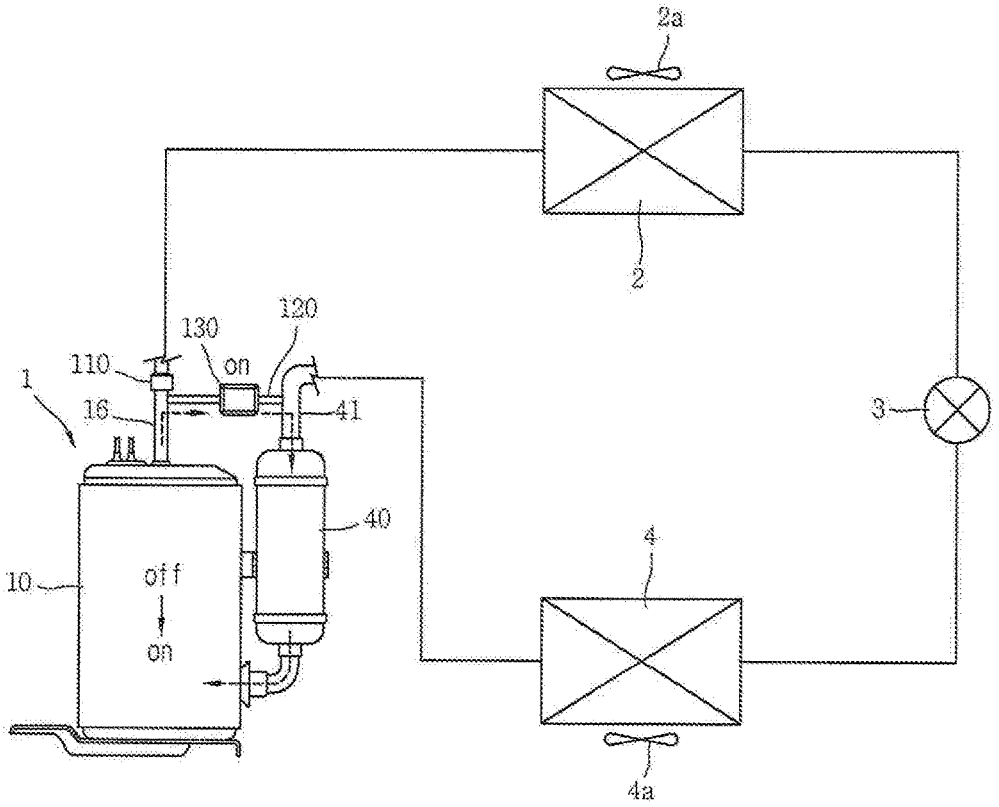

FIGS. 3A and 3B are longitudinal cross-sectional views illustrating a first valve and a second valve, respectively, in a compressor according to FIG. 2. FIGS. 4A and 4B are schematic views for explaining a differential pressure operation and a restart operation in the refrigerating cycle device according to FIG. 1.

Referring to FIG. 2, the check valve 110 may include a uni-directional valve capable of blocking refrigerant from flowing into the compressor casing 10. The check valve 110 may include an electronic valve, but a mechanical valve may be appropriate in consideration of cost, and reliability, for example.

Referring to FIG. 3A, the first valve 110 may include a housing 111 provided to communicate with the middle of the discharge pipe 16, and a valve body 112 accommodated in the housing 111 to open or close the housing 111 while moving according to a pressure difference therebetween. Both ends of the housing 111 may be open to form a condenser side open end (first open end) 111*a* and a compressor side open end (second open end) 111*b*. A valve space 111*c* that allows the valve body 112 to move therein may be formed in an extended manner between the first open end 111*a* and the second open end 111*b*.

The first open end 111*a* may be open and connected to the discharge pipe 16, and a valve cover 113 having a penetration hole 113*a* to be opened or closed by the valve body 112 may be coupled to the second open end 111*b*. The valve body 112 may be formed in a piston shape, and may be formed with a thin plate body in consideration of valve responsiveness, for example.

The valve body 112 may be formed with a gas communication groove 112*a* at a central portion thereof. As a result, when the valve body 112 is brought into contact with the first open end 111*a*, the first open end 111*a* may be open, but when the valve body 112 is brought into contact with the second open end 111*b*, it may be possible to completely block the penetration hole 113*a* of the valve cover 113 provided in the second open end 11*b*.

Referring to FIG. 4A, by the first valve 110 according to this embodiment, it may be possible to prevent refrigerant exhausted in a condenser direction through the discharge pipe 16 from the inner space 10*a* of the compressor casing 10 from flowing back into the inner space 10*a* of the compressor casing 10 during an equilibrium pressure process that occurs during a stop of the compressor or when the compressor is stopped, thereby allowing the refrigerant to move only in the direction of the accumulator 40 from the condenser 2 through the expansion valve 3 and evaporator 4 according to a pressure difference. When a condenser fan 2*a* or evaporator fan 4*a* is operated during this process, refrigerant passing through the condenser 2 and evaporator 4 may exchange heat with air to enhance an energy efficiency of the refrigerating cycle device.

As described above, a bypass pipe 120 may be provided between the middle of the discharge pipe 16 and the suction side of the accumulator 40, and a solenoid valve (hereinafter, "second valve") 130 that selectively opens or closes the bypass pipe 120 may be provided in a middle or middle portion of the bypass pipe 120. Further, the second valve 130 may be electrically connected to a controller 140 that controls the entire refrigerating cycle device including the second valve 130.

One or a first end of the bypass pipe 120 may be connected to a side of the condenser 2 based on the first valve 110, and the other or a second end of the bypass pipe 120 may be connected to a middle or middle portion of the refrigerant pipe 41 connected to a suction side of the accumulator 40. The one end of the bypass pipe 120 may be connected to the side of the condenser 2 based on the first valve 110, but in this case, an equilibrium pressure operation should be carried out for a refrigerant pipe between the compressor and the condenser, and thus, a time required for equilibrium pressure may be delayed by that amount of time or by a certain amount of time.

An inner diameter (D1) of the bypass pipe 120 may be formed to be the same or less than an inner diameter (D2) of the refrigerant pipe 41. If the inner diameter (D1) of the bypass pipe 120 is larger than the inner diameter (D2) of the refrigerant pipe 41, a flow rate of refrigerant is reduced to delay a time required for equilibrium pressure as well as a size of the second valve 130 must be increased by that size, increasing costs.

The second valve 130 may be configured with or as a bi-directional valve, an opening amount of which may be electrically controlled by the controller 140. Accordingly, the second valve 130 may control the opening amount to adjust a time required for equilibrium pressure.

Referring to FIG. 38, the second valve 130 according to an embodiment may include a housing 131 provided in the middle of the bypass pipe 120 and formed with a communication path 131*a* to communicate between a high pressure side 121 and a low pressure side 122 of the bypass pipe 120, a drive unit or drive 132 formed within the housing 131 and electrically connected to the controller 140, and a valve body 133 coupled to a mover (not shown) of the drive unit 132 to open or close the communication path 131*a* according to whether or not power is applied to the drive unit 132. When a user selects restart for the refrigerating cycle device which has been temporarily stopped, a suction side pressure and a discharge side pressure may be allowed to rapidly reach an equilibrium pressure by the second valve 130 according to this embodiment, thereby efficiently implementing restart even in a high pressure compressor, such as a rotary compressor.

Referring FIG. 4B, when the user selects restart for the temporarily stopped refrigerating cycle device, the second valve 130 may be switched to an open state to allow refrigerant at a discharge pipe side with a relatively high pressure to rapidly move to a suction pipe side with a relatively low pressure (i.e., a refrigerant pipe connected to the suction side of the accumulator), thereby instantly establishing an equilibrium between a suction side and a discharge side pressure of the compressor. Accordingly, a difference between the suction side pressure and discharge side pressure may be substantially the same or less than 1 kgf/cm$^2$, thereby providing a condition of restarting the rotary compressor.

Consequently, even when the refrigerating cycle device, to which a high pressure compressor, such as a rotary compressor, is applied, is temporarily stopped, a so-called differential pressure operation for operating a fan of the refrigerating cycle device for the stopped period of time may be allowed to continue, thereby enhancing energy efficiency. Moreover, during restart, an equilibrium may be rapidly established between the suction pressure and the discharge pressure to efficiently implement the restart of the compressor, thereby enhancing reliability.

Figure 5:
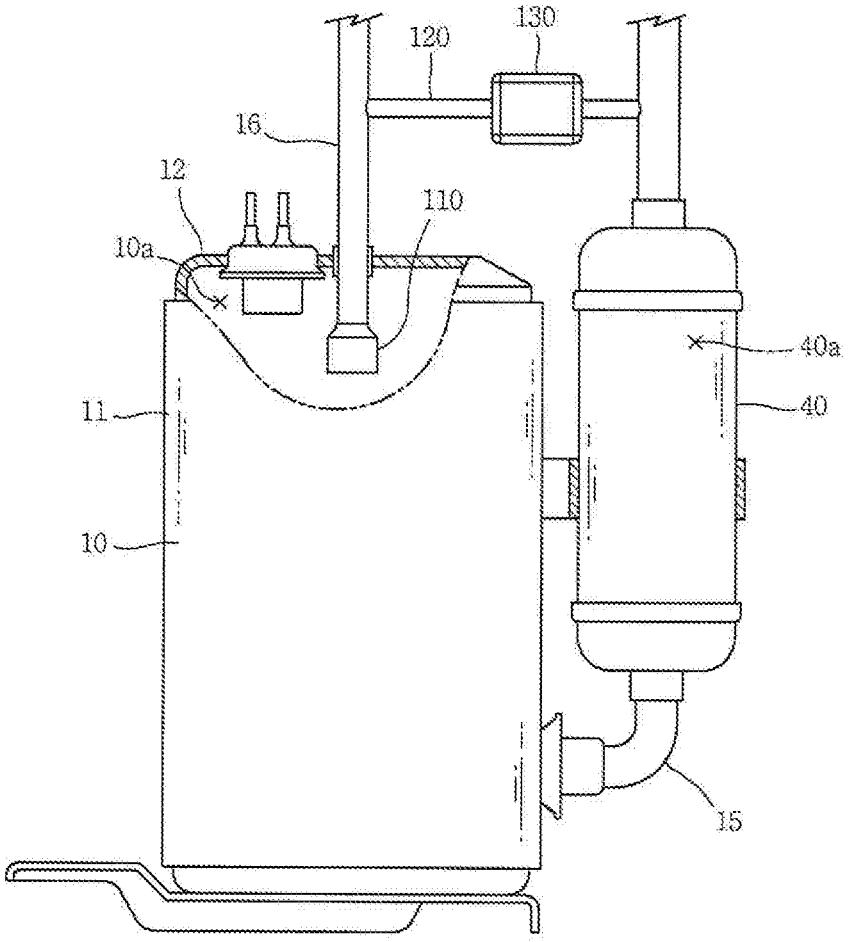
FIG. 5 is a schematic view illustrating another embodiment for an installation location of a first valve in the refrigerating cycle device according to FIG. 1.

Another embodiment for an installation location of the first valve in a rotary compressor according to an embodiment is illustrated in FIG. 5. More particularly, the first valve is provided at an outside of the compressor casing in the previous embodiment; however, in this embodiment, the first valve 110 is provided in the inner space 10*a* of the compressor casing 10.

In this case, the first valve 110 may be additionally provided using a pipe path that communicates with the discharge pipe 16, but may also be provided by connecting the foregoing housing 111 of the first valve 110 to an end portion of the discharge pipe 16. Even when the first valve 110 is provided in the inner space 10*a* of the compressor casing 10, the second valve 130 may be provided at a same location as that of the previous embodiment, and a resultant basic configuration and operational effects thereof may be substantially the same as those of the previous embodiment, and thus, detailed description thereof has been omitted.

However, according to this embodiment, the first valve 110 may be provided in the inner space 10*a* of the compressor casing 10, and therefore, a substantial inner volume of the compressor 1 may be decreased compared to a case in which the first valve 110 is provided in the middle of the discharge pipe 16 as illustrated in the previous embodiment, thereby further reducing a time required for equilibrium pressure.

Figure 6:
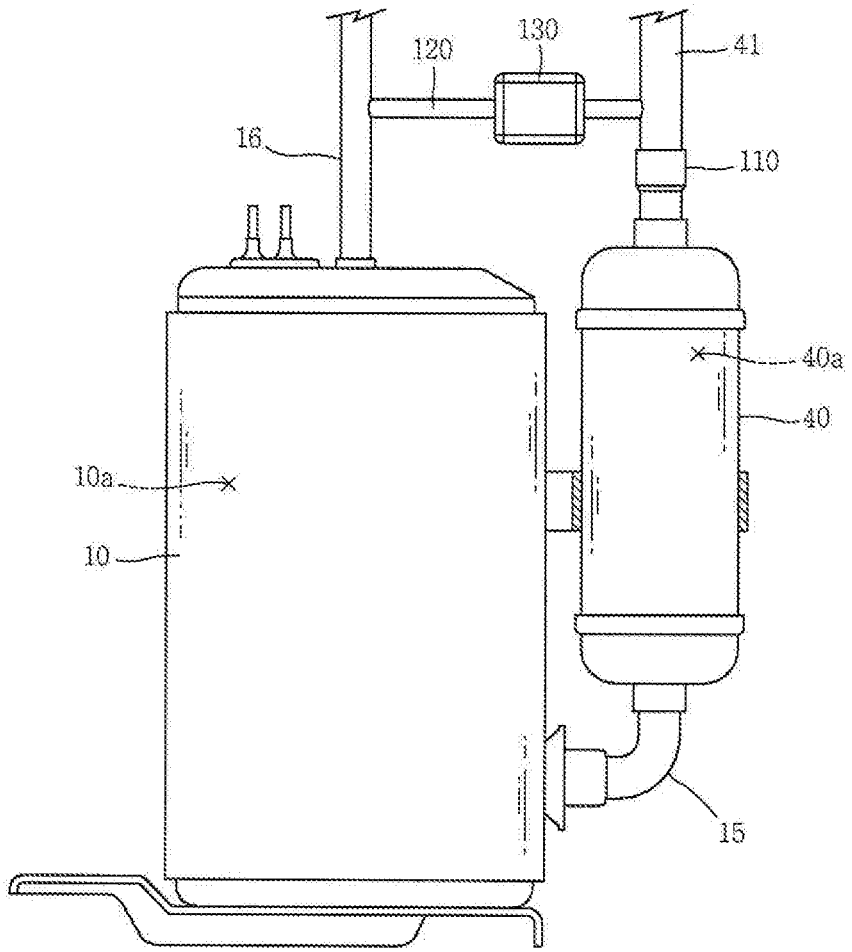
FIGS. 6 and 7 are schematic views illustrating still another embodiment for an installation location of a first valve in the refrigerating cycle device according to FIG. 1.
Figure 7:
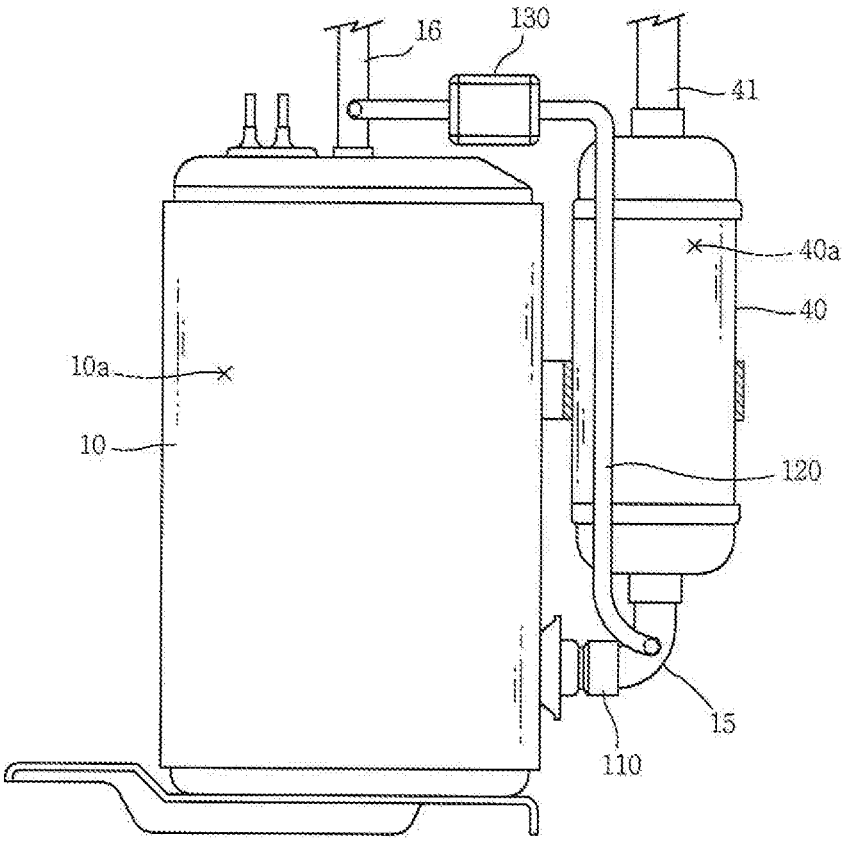

Still another embodiment for an installation location of the first valve in a rotary compressor according to an embodiment is illustrated in FIGS. 6 and 7. More particularly, the first valve 110 is provided at an outside or inside of the compressor casing in the previous embodiment; however, in this embodiment, the first valve 110 is provided at an inlet side or outlet side of the accumulator 40.

For example, as illustrated in FIG. 6, the first valve 110 may be provided at the refrigerant pipe 41 connected to an inlet side of the accumulator 40, and a high pressure side and a low pressure side of the bypass pipe 120 may be connected to the discharge pipe 16 and an upstream side (evaporator side) compared to the first valve 110, respectively. As a result, it may be possible to block refrigerant from flowing in an evaporator direction from the accumulator 40.

Further, as illustrated in FIG. 7, the first valve 110 may be provided at a suction pipe 15, which may be an L-shaped pipe, connected to an outlet side of the accumulator 40, and a high pressure side and a low pressure side of the bypass pipe 120 may be connected to the compressor casing 10 and the suction pipe 15, respectively. As a result, it may be possible to block refrigerant mixed with oil in the inner space 10*a* of the compressor casing 10 from flowing in an accumulator direction through a gap between each component.

Accordingly, embodiments may sufficiently secure a differential pressure section or time period to operate a fan of the refrigerating cycle device even in a state in which the compressor is stopped so as to enhance energy efficiency while at the same time the effect of rapidly establishing an equilibrium pressure during restart to efficiently restart the compressor is the same as that of the previous embodiment.

However, according to embodiments disclosed herein, when oil is sealed into the compressor casing, a discharge pipe may be used without installing an additional oil-sealed pipe, thereby reducing material costs and simplifying fabrication process compared to installing the first valve at the discharge pipe. In a case of the previous embodiments, when the first valve, which may be a uni-directional valve is provided, at the discharge pipe, it may not be allowed to seal oil using the discharge pipe, and thus, an additional oil-sealed pipe may be required, but according to this embodiment, it may be allowed to seal oil using the discharge pipe without any additional oil-sealed pipe as described above.

Figure 8:
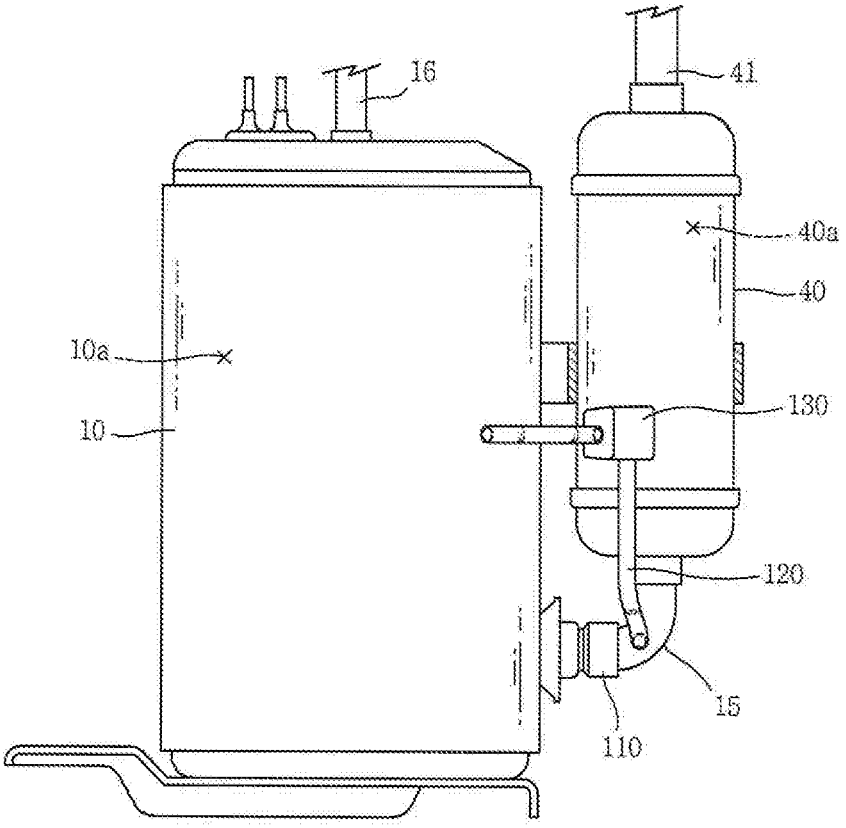
FIGS. 8 and 9 are schematic views illustrating another embodiment for an installation location of a second valve in the refrigerating cycle device according to FIG. 1.
Figure 9:
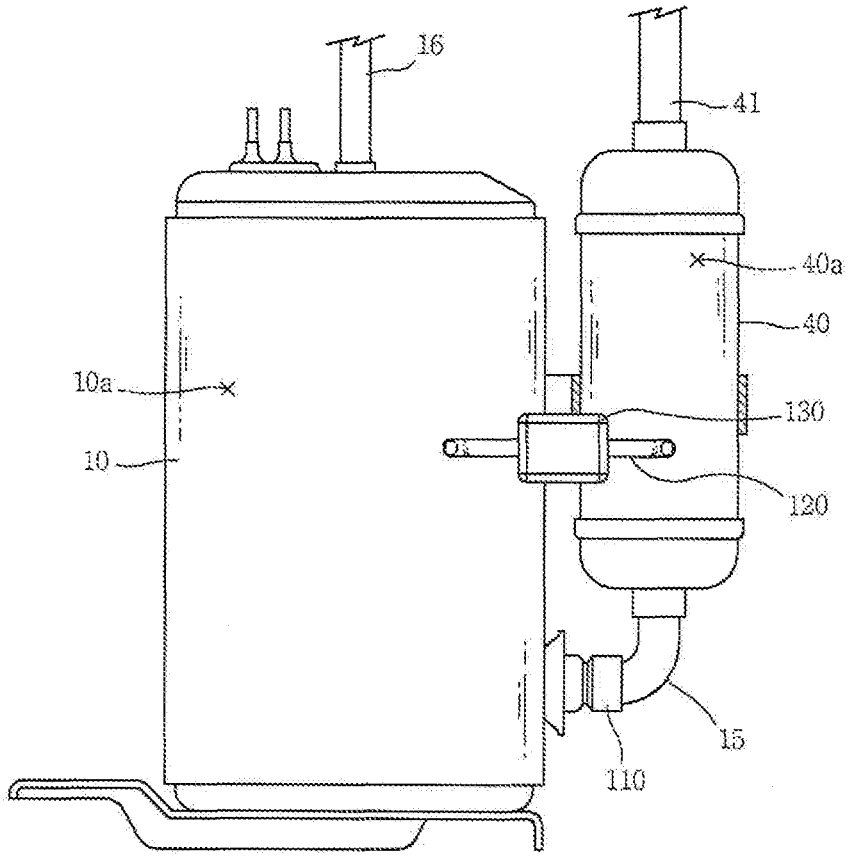

Another embodiment for an installation location of the second valve in a rotary compressor according to an embodiment is illustrated in FIGS. 8 and 9. The second valve is provided in the middle of the bypass pipe connected between a discharge pipe and a suction side refrigerant pipe of the accumulator in the previous embodiments; however, in this embodiment, an end of the bypass pipe 120 may be connected to the inner space 10*a* of the compressor casing 10.

In this case, as illustrated in FIG. 8, a high pressure side and a low pressure side of the bypass pipe 120 may be connected to the inner space 10*a* of the compressor casing 10 and the middle of the suction pipe 15 connected to an outlet side of the accumulator 40, respectively, or as illustrated in FIG. 9, a high pressure side and a low pressure side of the bypass pipe 120 may be connected to the inner space 10*a* of the compressor casing 10 and the inner space 40*a* of the accumulator 40, respectively.

As described above, even when an end of the bypass pipe is connected to the inner space of the compressor casing, a resultant basic configuration and operational effects of the second valve may be substantially the same as those of the previous embodiments, and thus, detailed description thereof has been omitted.

However, in a case in which an end of the bypass pipe 120 is connected to the inner space 10*a* of the compressor casing 10 and the other end of the bypass pipe 120 is connected to the suction pipe 15 or the inner space 40*a* of the accumulator 40, a distance between the inner space 10*a* of the compressor casing 10 and the inner space 40*a* of the accumulator 40 for substantially establishing an equilibrium pressure may be decreased, thereby further reducing a time required for equilibrium pressure.

Moreover, as described above, the first valve may be provided at the discharge pipe or a suction side refrigerant pipe of the accumulator, as illustrated in the previous embodiments, but may also be provided at a discharge side suction pipe of the accumulator as illustrated in this embodiment. In this case, the first valve may be provided at a side of the compressor casing at a high pressure side compared to the other end of the bypass pipe.

The embodiments have been described with a rotary compressor for an example, but will be applicable to all high pressure compressors in which an inner space of the casing is a discharge space.

Embodiments disclosed herein provide a compressor capable of sufficiently securing a time required for equilibrium pressure for resolving a differential pressure between a suction pressure and a discharge pressure when the compressor is stopped, as well as rapidly reaching an equilibrium pressure during a restart. Embodiments disclosed herein provide a compressor capable of allowing a refrigerating cycle device to exchange heat for a time required for equilibrium pressure during a temporary stop.

Embodiments disclosed herein provide a high pressure compressor that may include a casing in which refrigerant discharged from a compression unit or device may be filled into an inner space provided with a drive motor; a suction pipe directly connected to a suction port of the compression unit; a discharge pipe connected to an inner space of the casing; a first valve provided at the discharge pipe or suction pipe to flow the discharged refrigerant from a high pressure side to a low pressure side during the stop of the drive motor, a bypass pipe connected between a discharge side and a suction side around the compression unit; and a second valve provided at the bypass pipe to move refrigerant at the high pressure side to the low pressure side through the bypass pipe. The first valve may be provided at the discharge pipe at an outside or inside of the casing. Further, the first valve may be provided at the suction pipe.

An accumulator having an inner space separated from the inner space of the casing may be connected to the suction pipe. The first valve may be provided at the suction side or discharge side to communicate with the inner space of the accumulator. The first valve may be formed with a unidirectional valve.

An accumulator having an inner space separated from the inner space of the casing may be connected to the suction pipe. The bypass pipe may be connected between the discharge pipe and the suction side or discharge side communicating with and the inner space of the accumulator.

Further, an accumulator having an inner space separated from the inner space of the casing may be connected to the suction pipe. The bypass pipe may be connected between the inner space of the casing and the inner space of the accumulator. The second valve may be formed with a solenoid valve.

The compression unit may include a cylinder provided at an inner space of the casing to form a compression space; a roller configured to compress refrigerant while rotating in the compression space of the cylinder; and a vane brought into contact with an outer circumferential surface of the roller to divide the compression space into a suction chamber and a compression chamber while performing a sliding movement in the cylinder by the roller.

Embodiments disclosed herein further provide a high pressure compressor that may include a casing in which an inner space thereof forms a high pressure portion and a compression unit or device is provided at the inner space; a first refrigerant passage connected between a suction side and a discharge side based on the compression unit; a second refrigerant passage branched from the first refrigerant passage to reduce a distance between an inlet of the first refrigerant passage connected to the suction side of the compression unit and an outlet of the first refrigerant passage connected to the discharge side of the compression unit based on the compression unit; and a solenoid valve provided at the second refrigerant passage to selectively open or close the second refrigerant passage. A check valve to block refrigerant at a high pressure side from flowing to a low pressure side may be provided at the first refrigerant passage. The check valve may be located at a downstream side with respect to the compression unit compared to a position from which the first refrigerant passage and the second refrigerant passage may be branched. An accumulator having an inner space separated from the inner space of the casing may be connected to the first refrigerant passage, and the check valve may be provided at the suction side or discharge side to communicate with the inner space of the accumulator.

The compression unit may include a cylinder provided at an inner space of the casing to form a compression space; a roller configured to compress refrigerant while rotating in the compression space of the cylinder; and a vane brought into contact with an outer circumferential surface of the roller to divide the compression space into a suction chamber and a compression chamber while performing a sliding movement in the cylinder by the roller.

Embodiments disclosed herein further provide a refrigerating cycle device that may include a compressor; a condenser corresponding to the compressor; and an evaporator connected to the condenser. The compressor may be configured with the foregoing high pressure compressor.

Further, at least one of the condenser fan or the evaporator fan may be operated in a state that the compressor is stopped. Furthermore, at least one of the condenser fan or the evaporator fan may be operated in a state that the second valve is stopped. Additionally, the compressor may be stopped in a state that the second valve is closed, and the compressor may be operated in a state that the second valve is open.

Consequently, a high pressure compressor according to embodiments disclosed herein and a refrigerating cycle device to which the high pressure compressor may be applied may provide a check valve that blocks refrigerant from flowing from a high pressure side to a low pressure side, as well as provide a bypass pipe that allows refrigerant to bypass from the high pressure side to the low pressure side and a solenoid valve that selectively opens or closes the bypass pipe, thereby allowing a so-called differential pressure operation for operating a fan in the refrigerating cycle device to continue for a stop time even when a high pressure compressor, such as a rotary compressor, is temporarily stopped in the refrigerating cycle device to which the high pressure compressor is applied, thereby enhancing energy efficiency. Moreover, during restart, a suction pressure and a discharge pressure may rapidly reach an equilibrium pressure to efficiently carry out the restart of the compressor, thereby enhancing reliability.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A high pressure compressor, comprising:

a casing in which refrigerant discharged from a compression device is filled into an inner space provided with a drive motor;

a suction pipe directly connected to a suction port of the compression device;

a discharge pipe connected to the inner space of the casing;

an accumulator having an inner space provided at one side of the casing, wherein the inner space of the accumulator communicates with the suction port of the compression device;

a first valve provided at the discharge pipe or the suction pipe to control a flow of the discharged refrigerant from a high pressure side to a low pressure side when the drive motor is stopped;

a bypass pipe connected between a discharge side and a suction side of the compression device;

a second valve provided at the bypass pipe to control a flow of the refrigerant at the high pressure side to the low pressure side through the bypass pipe; and a controller configured to check a switching state of the second valve prior to restarting the drive motor, wherein a first end of the bypass pipe communicates with the inner space of the casing and a second end of the bypass pipe communicates with the inner space of the accumulator, and wherein the second valve is configured to open the bypass pipe when the drive motor is stopped and close the bypass pipe when the drive motor is restarted, so as to close the bypass pipe when a compression load occurs at a compression space and open the bypass pipe when the compression load is removed from the compression space.

2. The high pressure compressor of claim 1, wherein the first valve is provided at the discharge pipe at an outside or inside of the casing.

3. The high pressure compressor of claim 1, wherein the first valve is provided at the suction pipe.

4. The high pressure compressor of claim 1, wherein the accumulator having the inner space separated from the inner space of the casing is connected to the suction pipe, and wherein the first valve is provided at the suction side or the discharge side of the compression device and communicates with the inner space of the accumulator.

5. The high pressure compressor of claim 1, wherein the accumulator having the inner space separated from the inner space of the casing is connected to the suction pipe, and wherein the bypass pipe is connected between the discharge pipe and the suction side or the discharge side of the compression device and communicates with the inner space of the accumulator.

6. The high pressure compressor of claim 1, wherein the accumulator having the inner space separated from the inner space of the casing is connected to the suction pipe, and wherein the bypass pipe is connected between the inner space of the casing and the inner space of the accumulator.

7. The high pressure compressor of claim 1, wherein the compression device includes:

a cylinder provided at the inner space of the casing to form a compression space;

a roller configured to compress the refrigerant while rotating in the compression space of the cylinder; and a vane brought into contact with an outer circumferential surface of the roller to divide the compression space into a suction chamber and a compression chamber while performing a sliding movement in the cylinder by the roller.

8. A high pressure compressor, comprising:

a casing in which an inner space thereof forms a high pressure portion, wherein a compression device is provided at the inner space;

a first refrigerant passage connected between a suction side and a discharge side of the compression device;

a second refrigerant passage branched from the first refrigerant passage to reduce a distance between an inlet of the first refrigerant passage connected to the suction side of the compression device and an outlet of the first refrigerant passage connected to the discharge side of the compression device; and a solenoid valve provided at the second refrigerant passage to selectively open or close the second refrigerant passage, wherein a check valve that blocks a refrigerant at a high pressure side from flowing to a low pressure side is provided at the first refrigerant passage, wherein an accumulator having an inner space separated from the inner space of the casing is connected to the first refrigerant passage, wherein the check valve is provided at the suction side or the discharge side of the compression device and communicates with the inner space of the accumulator, and wherein the solenoid valve is configured to open the second refrigerant passage when a drive motor is stopped and close the second refrigerant passage when the drive motor is restarted, so as to close the second refrigerant passage when a compression load occurs at the compression device and open the second refrigerant passage when the compression load is removed from the compression device.

9. The high pressure compressor of claim 8, wherein the check valve is located at a downstream side with respect to the compression device compared to a position from which the first refrigerant passage and the second refrigerant passage are branched.

10. A refrigerating cycle device, comprising:

a compressor;

a condenser connected to the compressor;

a condenser fan provided at one side of the condenser;

an evaporator connected to the condenser; and an evaporator fan provided at one side of the evaporator, wherein the compressor includes:

a casing in which refrigerant discharged from a compression device is filled into an inner space provided with a drive motor;

a suction pipe directly connected to a suction port of the compression device;

a discharge pipe in communication with the inner space of the casing;

a first valve provided at the discharge pipe or the suction pipe to control a flow of the discharged refrigerant from a high pressure side to a low pressure side when the drive motor is stopped;

a bypass pipe connected between a discharge side and a suction side of the compression device;

a second valve provided at the bypass pipe to move the refrigerant at the high pressure side to the low pressure side through the bypass pipe; and a controller configured to check a switching state of the second valve prior to restarting the drive motor, wherein the compressor further includes an accumulator having an inner space provided at one side of the casing, wherein the inner space of the accumulator communicates with the suction port of the compression device, wherein a first end of the bypass pipe communicates with the inner space of the casing and a second end of the bypass pipe communicates with the inner space of the accumulator, and wherein the second valve is configured to open the bypass pipe when the drive motor is stopped and close the bypass pipe when the drive motor is restarted, so as to close the bypass pipe when a compression load occurs at a compression space and open the bypass pipe when the compression load is removed from the compression space.

11. The refrigerating cycle device of claim 10, wherein the first valve is provided at the discharge pipe at an outside or inside of the casing.

12. The refrigerating cycle device of claim 10, wherein the first valve is provided at the suction pipe.

13. The refrigerating cycle device of claim 10, wherein the accumulator having the inner space separated from the inner space of the casing is connected to the suction pipe, and wherein the first valve is provided at the suction side or the discharge side of the compression device and communicates with the inner space of the accumulator.

14. The refrigerating cycle device of claim 10, wherein the accumulator having the inner space separated from the inner space of the casing is connected to the suction pipe, and wherein the bypass pipe is connected between the discharge pipe and the suction side or the discharge side of the compression device and communicates with the inner space of the accumulator.

15. The refrigerating cycle device of claim 10, wherein the accumulator having the inner space separated from the inner space of the casing is connected to the suction pipe, and wherein the bypass pipe is connected between the inner space of the casing and the inner space of the accumulator.

16. The refrigerating cycle device of claim 10, wherein at least one of the condenser fan or the evaporator fan is operated in a state in which the compressor is stopped.

17. The refrigerating cycle device of claim 10, wherein at least one of the condenser fan or the evaporator fan is operated in a state in which the second valve is closed.

18. The refrigerating cycle device of claim 10, wherein the compressor is stopped in a state in which the second valve is closed, and the compressor is operated in a state in which the second valve is open.

19. The refrigerating cycle device of claim 10, wherein the compressor is a rotary compressor.

* * * * *